US005675866A

United States Patent [19]

Tseng

[11] Patent Number: 5,675,866

[45] Date of Patent: Oct. 14, 1997

[54] TOOL HANDLE OF A HAND TOOL

[76] Inventor: Sen Piao Tseng, P.O. Box 82-144, Taipei, Taiwan

[21] Appl. No.: 725,098

[22] Filed: Oct. 2, 1996

[51] Int. Cl.[6] ..... A47B 95/02

[52] U.S. Cl. ..... 16/110.5; 81/177.4

[58] Field of Search ..... 16/110.5, 110 R; 81/177.4, 490, 437–439; 215/390, 395, 396; 220/737, 756, 23.2, 23.4, 23.86

[56] References Cited

U.S. PATENT DOCUMENTS

| | | | |
|---|---|---|---|
| 3,667,518 | 6/1972 | Stillwagon, Jr. | 16/110.5 |
| 4,227,430 | 10/1980 | Jansson et al. | 16/110.5 |
| 4,449,559 | 5/1984 | Martinmass | 81/177.4 |
| 4,924,733 | 5/1990 | McKenzie | 81/177.4 |
| 5,499,562 | 3/1996 | Feng | 81/490 |

*Primary Examiner*—Chuck Y. Mah
*Attorney, Agent, or Firm*—Alfred Lei

[57] ABSTRACT

A tool handle for hand tools, including: a handle body having a polygonal coupling hole at a front end thereof adapted for holding a tool bit, two raised grip portions and two longitudinal open chambers alternatively arranged around the periphery, each longitudinal open chamber having an upper receiving section, a bottom coupling section, and two grooves in the bottom coupling sections at two opposite ends; and two tool boxes respectively mounted within the longitudinal open chambers of the handle body, each tool box including a box body adapted for loading in the upper receiving section of one longitudinal open chamber of the handle body, two outward coupling flanges bilaterally raised from the box body and adapted for coupling to the bottom coupling section of one longitudinal open chamber of the handle body, two tongues raised from a bottom side of the box body at two opposite ends and adapted for engaging the grooves of one longitudinal open chamber of the handle body, and a plurality of tool holes defined within the box body and adapted for holding different tool bits and accessories.

1 Claim, 10 Drawing Sheets

TOOL HANDLE OF A HAND TOOL

BACKGROUND OF THE INVENTION

1. Field of the Invention

This invention relates to tool handles, and relates more particularly to such a tool handle which has two toll boxes mounted in longitudinal open chambers in the periphery, and adapted for holding different tool bits and accessories.

2. Description of the Prior Art

Various tool handles with storage means for holding tool bits and accessories have been disclosed, and have appeared on the market. Exemplars are seen in Chinese Patent Publication No. 132,604 as shown in FIG. 1 (which was selected from original FIGS. 2 and 6), Chinese Patent Publication No. 137,944 as shown in FIG. 2 (which was selected from original FIG. 4), Chinese Patent Publication No. 155,929 as shown in FIG. 3 (which was selected from original FIGS. 2 and 3), Chinese Patent Publication No. 160,244 as shown in FIG. 4 (which was selected from original FIG. 1), Chinese Patent Publication No. 208,866 as shown in FIG. 5 (which was selected from original FIGS. 2 and 3), Chinese Patent Publication No. 243,731 as shown in FIG. 6 (which was selected from original FIGS. 1 and 2). These tool handles commonly have a hollow handle body adapted for holding tool bits and accessories, and cover means adapted for sealing the hollow handle body. Because of the arrangement of the cover means, access to the stored items is not convenient.

SUMMARY OF THE INVENTION

This invention relates a tool handle which has two toll boxes mounted in longitudinal open chambers in the periphery, and adapted for holding different tool bits and accessories.

It is one object of the present invention to provide a tool handle which is mounted with tool box means adapted for holding a variety of tool bits and accessories. It is another object of the present invention to provide a tool handle with attached tool box means which is handy, and easy to assemble. According to the preferred embodiment of the present invention, the tool handle comprises a handle body having a polygonal coupling hole at a front end thereof adapted for holding a tool bit, two raised grip portions and two longitudinal open chambers alternatively arranged around the periphery, each of the longitudinal open chambers having an upper receiving section, a bottom coupling section, and two grooves in the bottom coupling sections at two opposite ends; and two tool boxes respectively mounted within the longitudinal open chambers of the handle body, each tool box comprising a box body adapted for loading in the upper receiving section of one longitudinal open chamber of the handle body, two outward coupling flanges bilaterally raised from the box body and adapted for coupling to the bottom coupling section of one longitudinal open chamber of the handle body, two tongues raised from a bottom side of the box body at two opposite ends and adapted for engaging the grooves of one longitudinal open chamber of the handle body, and a plurality of tool holes defined within the box body and adapted for holding different tool bits and accessories.

DETAILED DESCRIPTION OF THE PREFERRED EMBODIMENT

Figure 1:
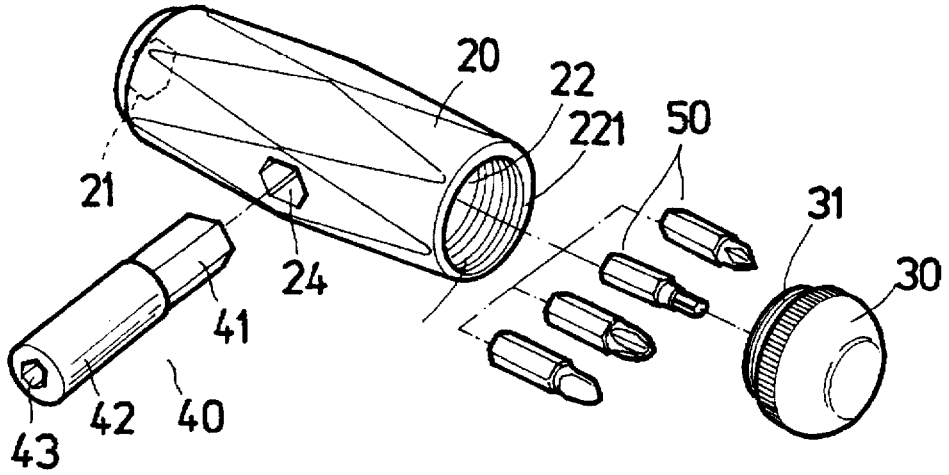
PRIOR ART FIG. 1
FIG. 1 shows two drawings selected from FIGS. 2 and 6 of Chinese Patent Publication No. 132,604.
Figure 1:
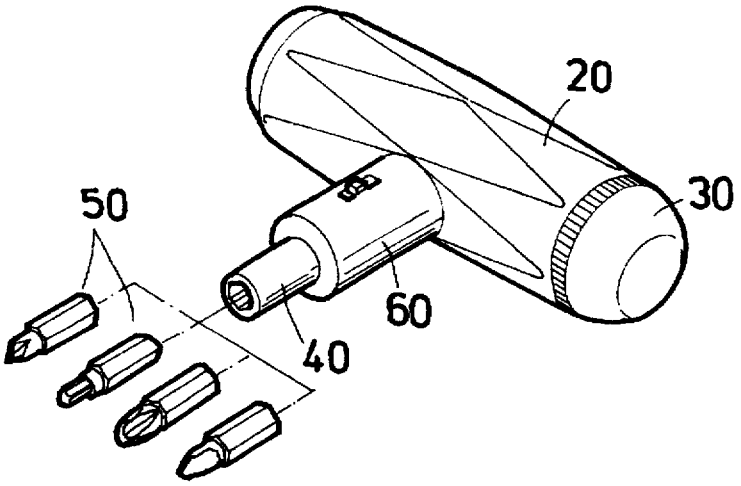
PRIOR ART FIG. 1
Figure 2:
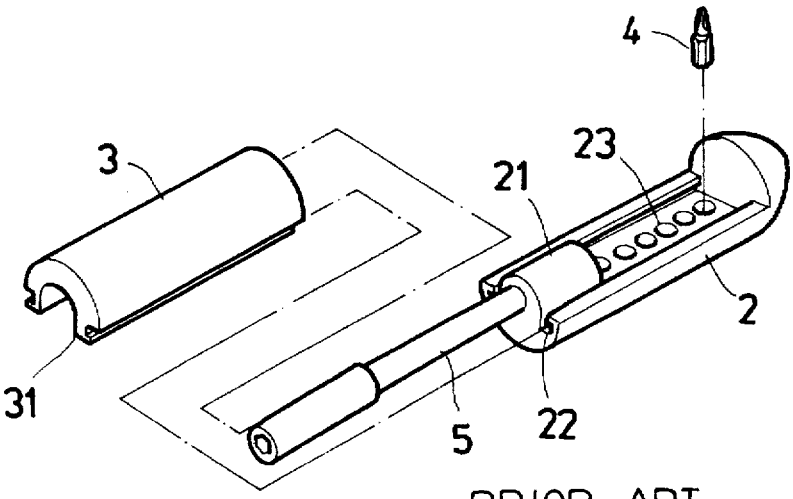
PRIOR ART FIG. 2
FIG. 2 shows a drawing selected from FIG. 4 of Chinese Patent Publication No. 137,944.
Figure 3:
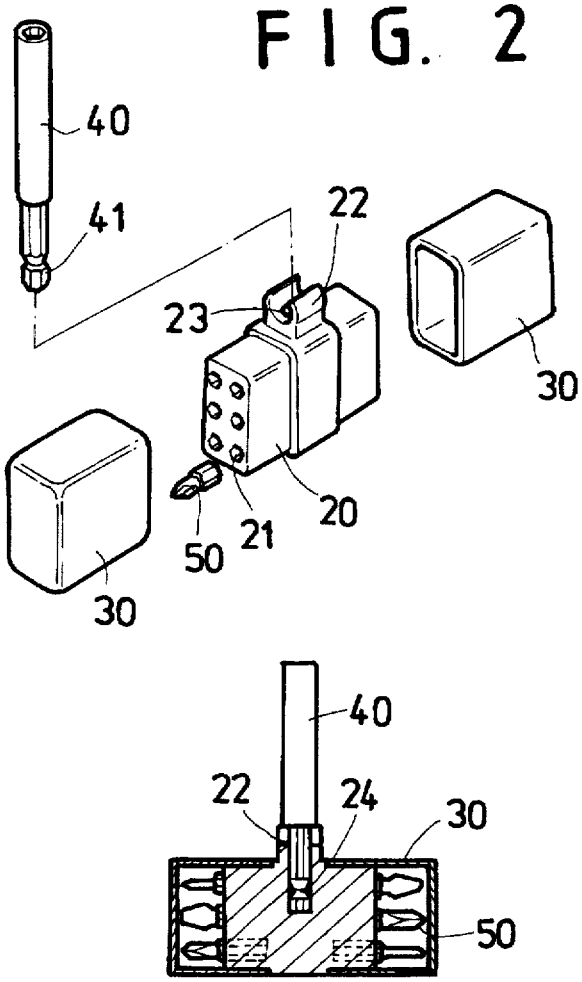
PRIOR ART FIG. 3
FIG. 3 shows two drawings selected from FIGS. 2 and of Chinese Patent Publication No. 155,929.
Figure 4:
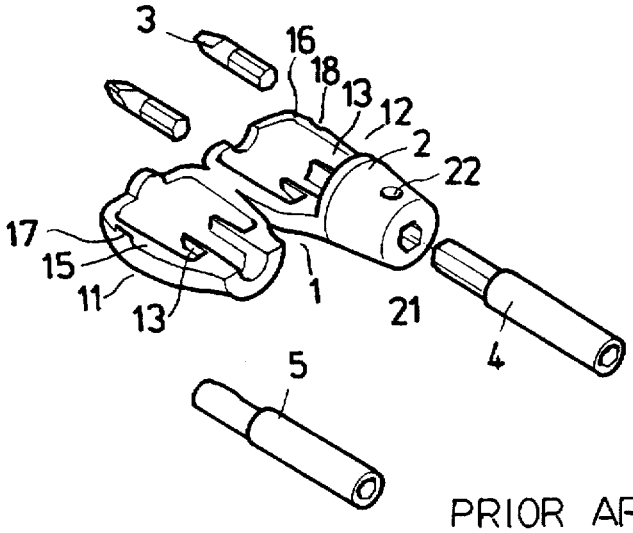
PRIOR ART FIG. 4
FIG. 4 shows a drawing selected from FIG. 1 of Chinese Patent Publication No. 160,244.
Figure 5:
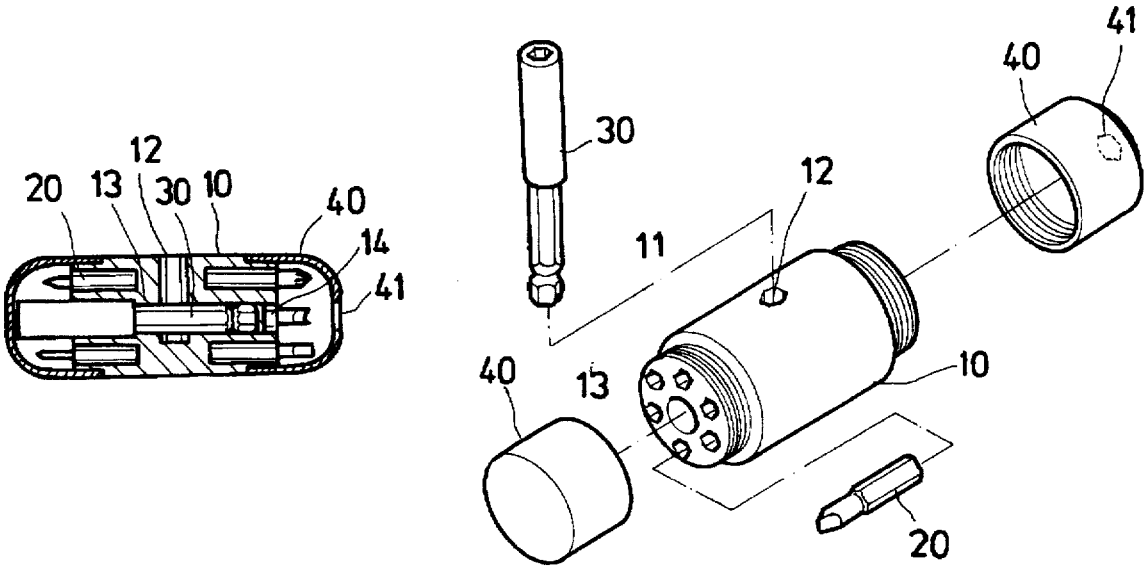
PRIOR ART FIG. 5
FIG. 5 shows two drawings selected from FIGS. 2 and of Chinese Patent Publication No. 208,866.
Figure 6:
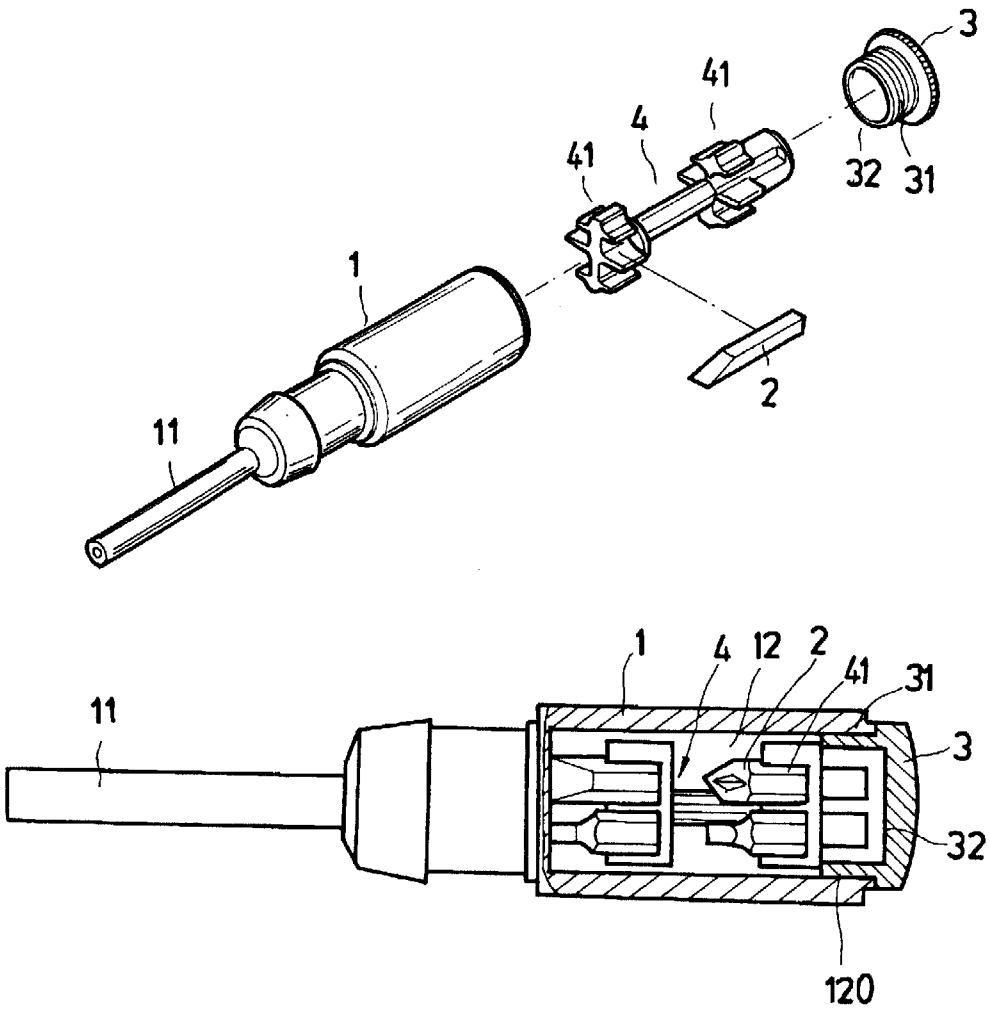
PRIOR ART FIG. 6
FIG. 6 show two drawings selected from FIGS. 1 and 2 of Chinese Patent Publication No. 243,731.

For the purpose of promoting an understanding of the principles of the invention, reference will now be made to the embodiment illustrated in the drawings. Specific language will be used to describe same. It will nevertheless, be understood that no limitation of the scope of the invention is thereby intended, such alterations and further modifications in the illustrated device, and such further applications of the principles of the invention as illustrated herein being contemplated as would normally occur to one skilled In the art to which the invention relates.

Figure 7:
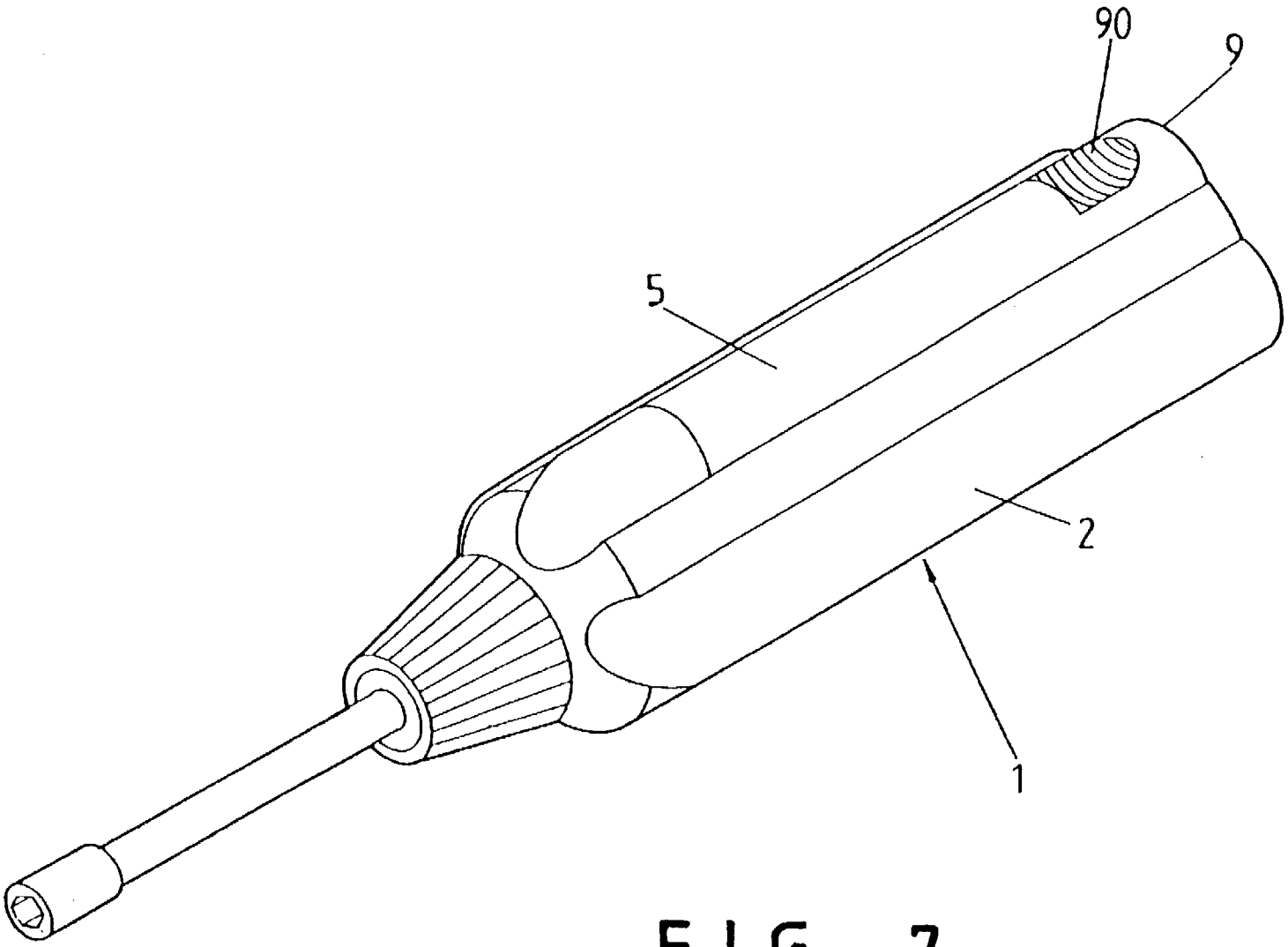
FIG. 7 is an elevational view of a tool handle according to the present invention.
Figure 8:
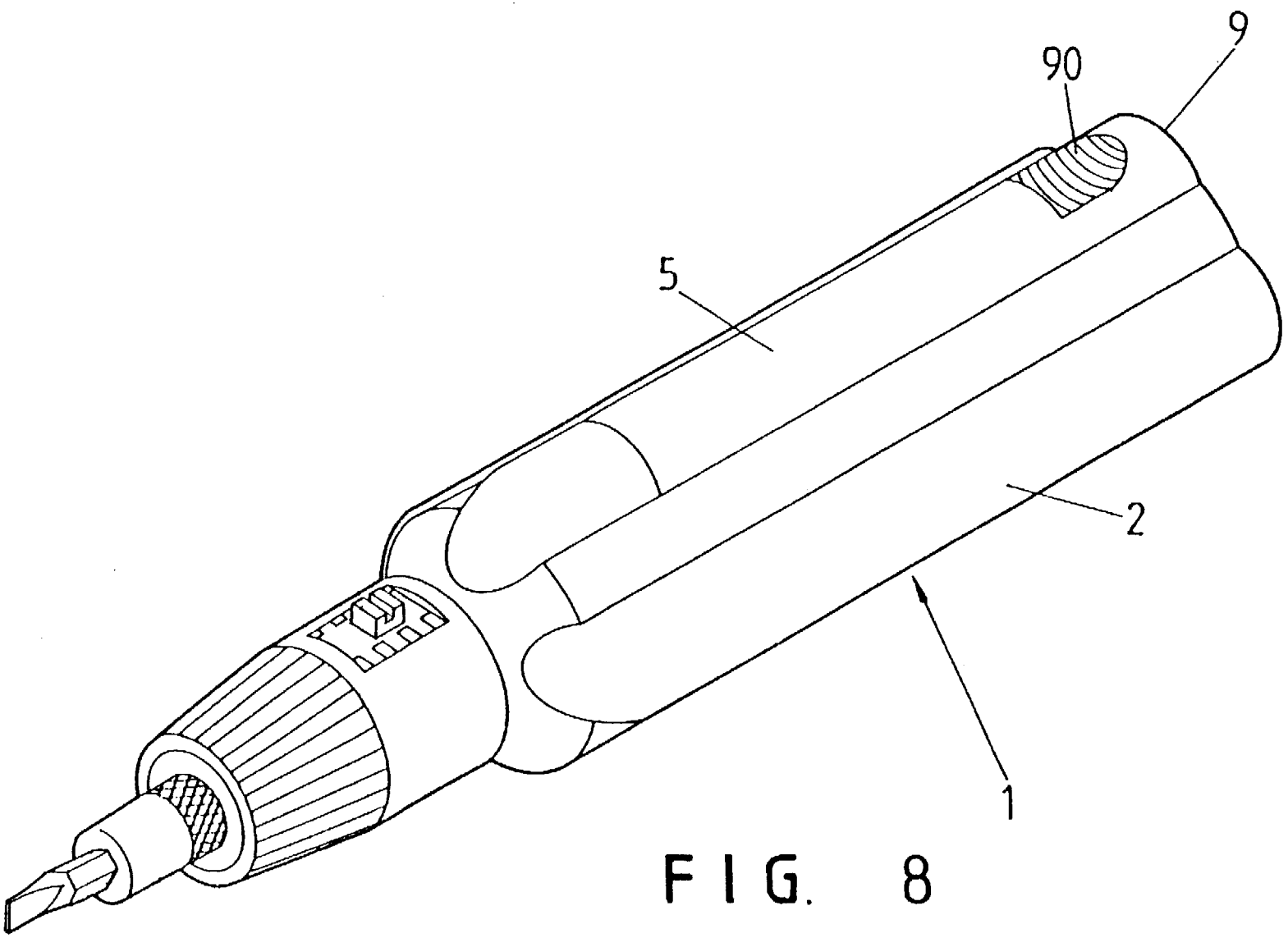
FIG. 8 is an elevational view of an alternate form of the present invention.
Figure 9:
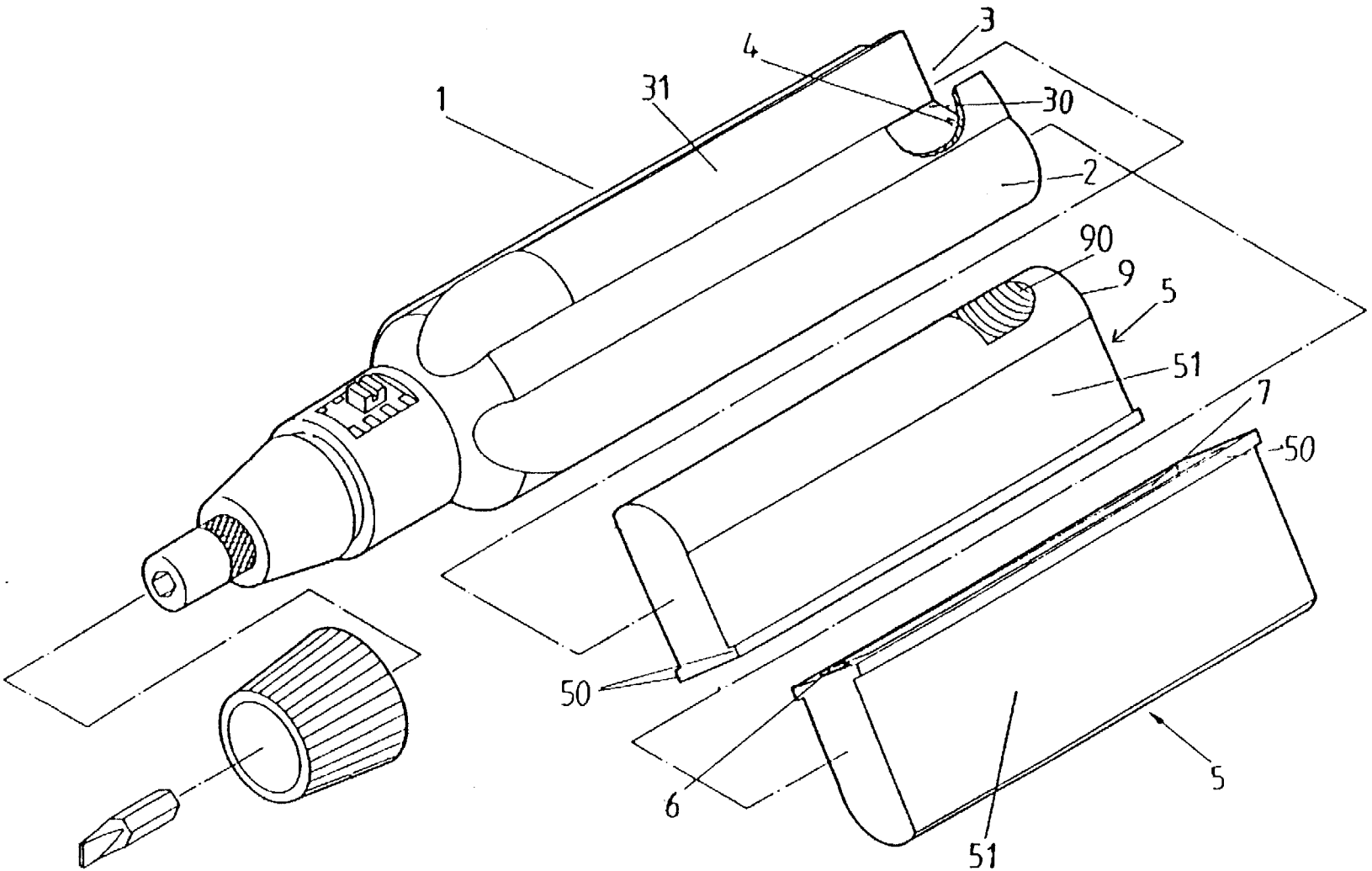
FIG. 9 is an exploded view of the handle body and the tool boxes according to the present invention.
Figure 11A:
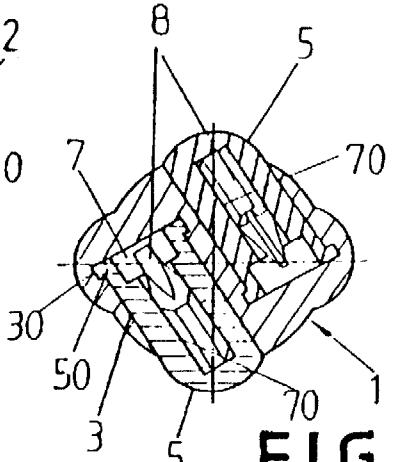
FIGS. 11A and 11B show two cross sections obtained from two different parts of FIG. 10.
Figure 11B:
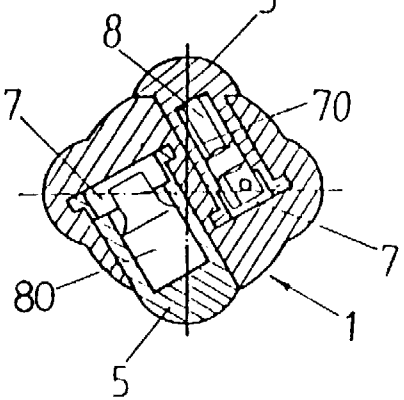
Figure 10:
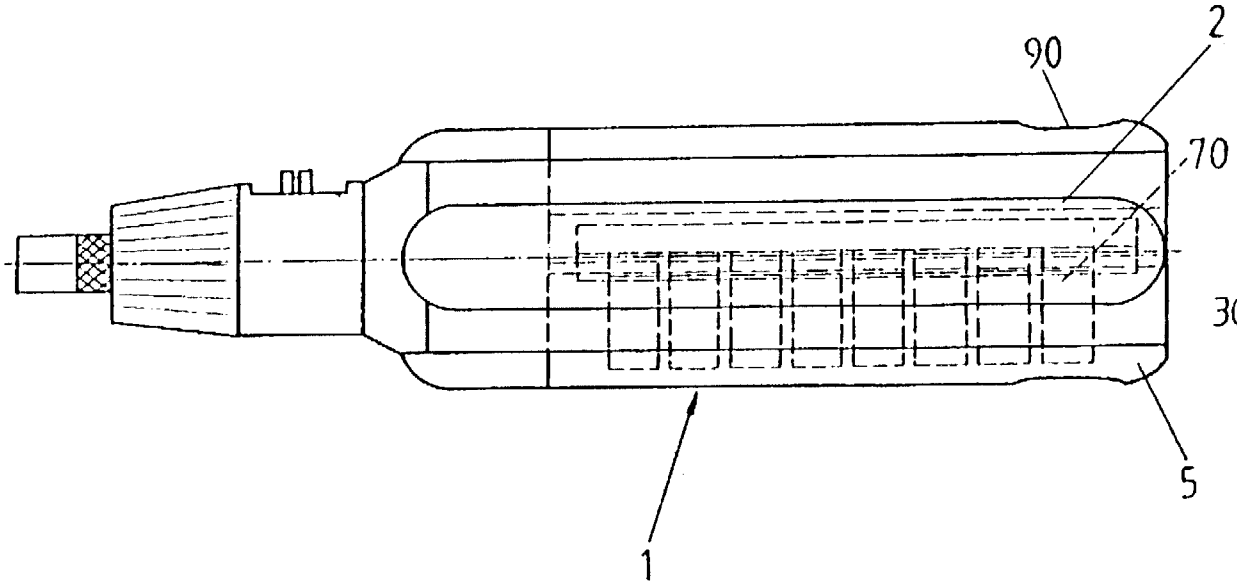
FIG. 10 is a plain sectional view of the tool handle shown in FIG. 8.
Figure 12:
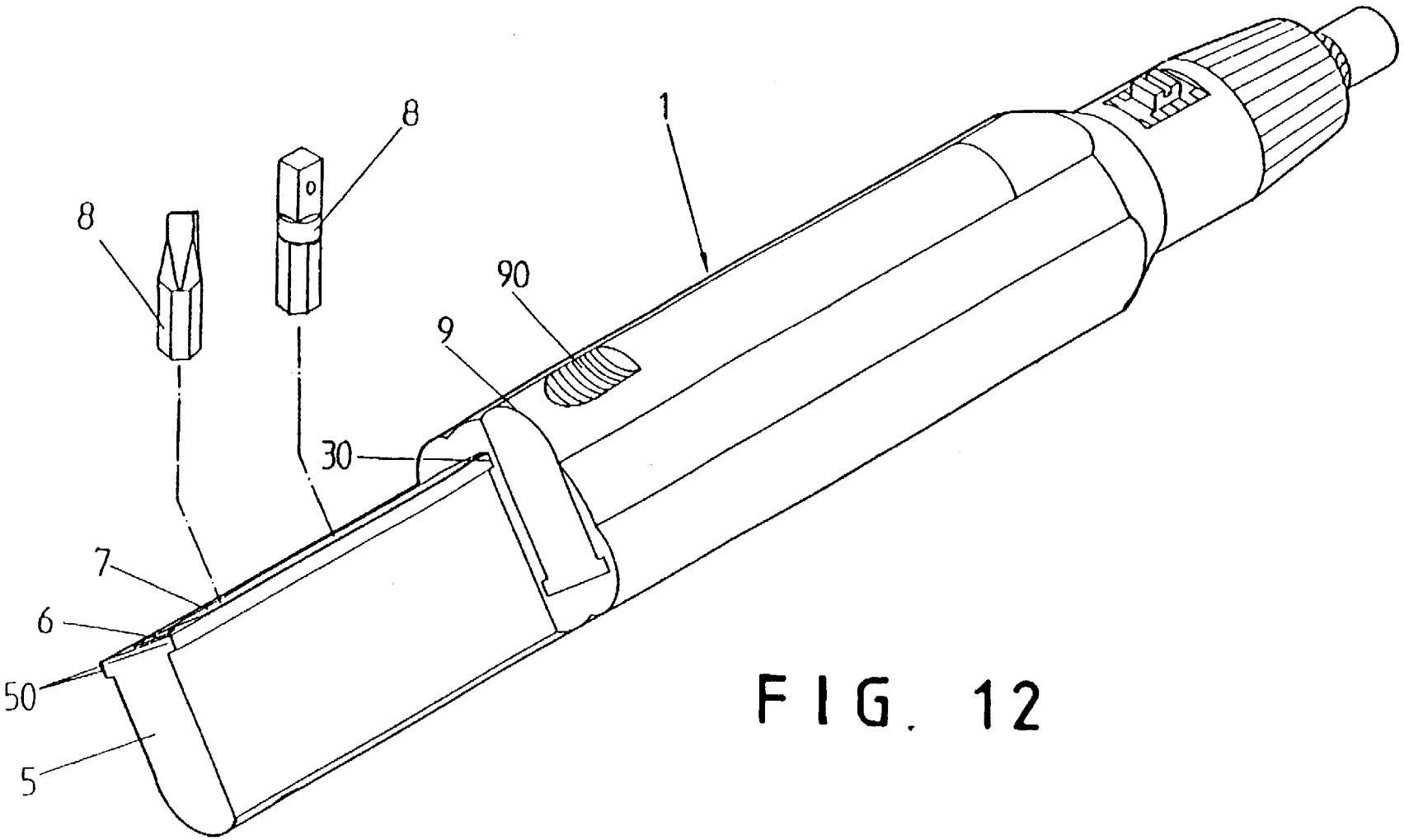
FIG. 12 is an applied view of the present invention, showing one tool box pulled out of the handle body.
Figure 13:
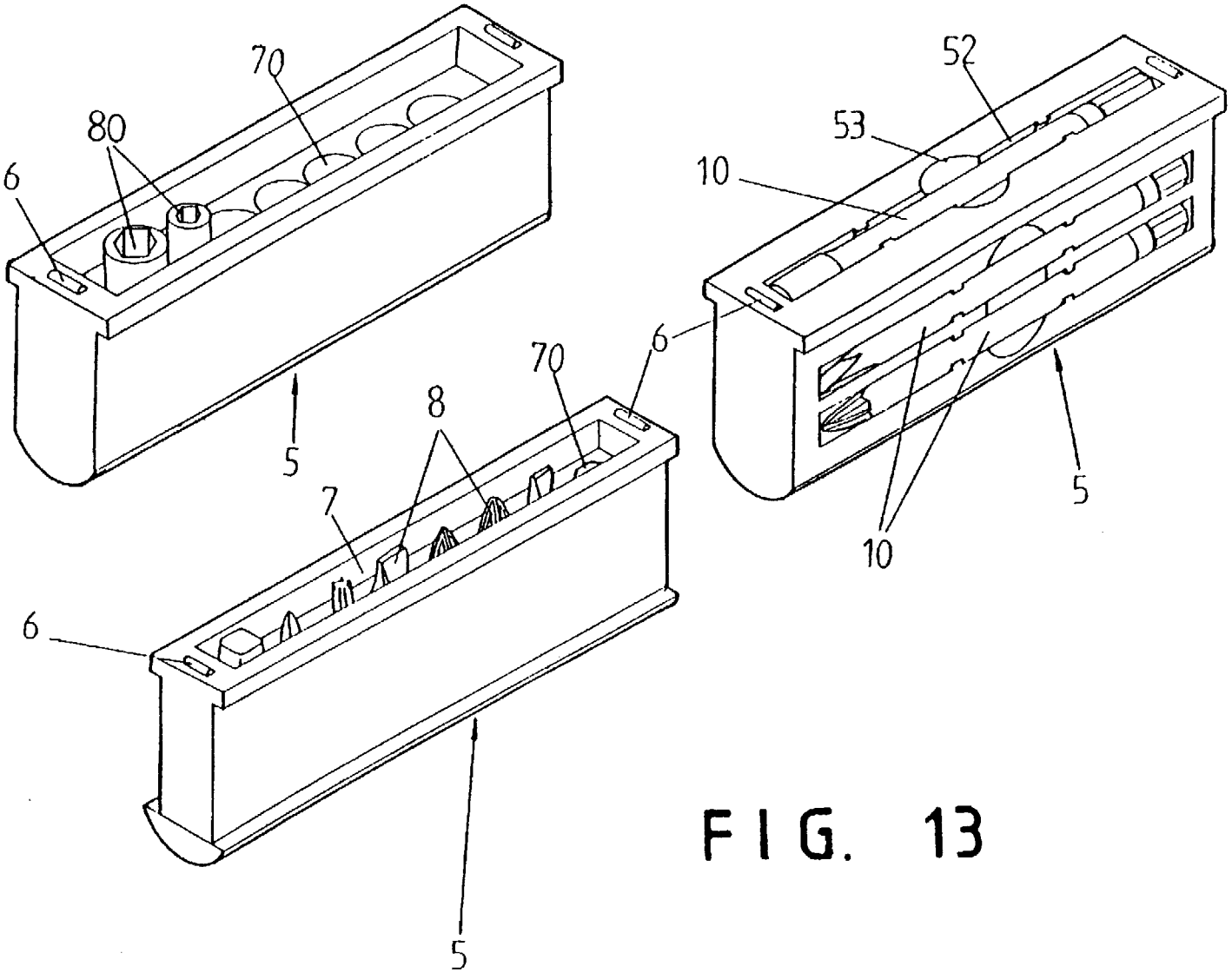
FIG. 13 shows different designs of tool boxes according to the present invention.

Referring to FIGS. 7, 8, and 9, the handle body 1 comprises two raised grip portions 2 and two longitudinal open chambers 3 alternatively arranged around the periphery. Each longitudinal open chamber 3 has a T-shaped cross section, and two grooves 4 at two opposite ends. Two tool boxes 5 are respectively mounted within the longitudinal open chambers 3. Each tool box 5 comprises a hollow box body 51 received in the upper receiving section 31 of one longitudinal open chamber 3, two outward coupling flanges 50 bilaterally raised from the border of the bottom of the box body 51 and fitted into the bottom coupling section 30 of the corresponding longitudinal open chamber 3, two tongues 6 raised from the bottom of the bottom of the box body 51 at two opposite ends and respectively forced into engagement with the grooves 4 of the corresponding longitudinal open chamber 3, an elongated bottom recess 7 at the bottom of the box body 5 between the tongues 6, and a plurality of vertical insertion slots 70 arranged in a line in the bottom recess 7 (see also FIG. 13). The vertical insertion slots 70 have different cross sections adapted for holding different tool bits 8 or accessories 80. Because the vertical insertion slots 70 is disposed inside the bottom recess 7, there is a space left in the bottom side of the box body 5 through which fingers can be inserted to pick up the tool bits 8 or accessories 80.

Referring to FIGS. from 9 10, 11A, 11B 12 and 13, again, when tool bits 8 or accessories 80 are respectively put in the vertical insertion slots 70 of the tool boxes 5, the tool boxes 5 are respectively mounted in the open chambers 3 of the handle 1 by fitting the respective outward flanges 50 into the coupling sections 30 of the respective open chambers 3 and forcing the respective tongues 6 into engagement with the respective grooves 4. Each tool box 5 further has a smoothly curved top surface 9, and a grooved recess 90 at the top surface 9. When pushing the grooved recess 90 outwards with the thumb, the corresponding tool box 5 is pushed outwards from the corresponding open chamber 3. When one tool box 5 is removed from the corresponding open chamber 3 of the handle 1, tool bits 8 or accessories 80 can then be put in or removed from the corresponding vertical insertion slots 70.

Referring to FIG. 13 again, as an alternate form of the present invention, each tool box 5 may be made having longitudinal compartments 52 at the bottom side as well as the lateral sides for holding elongated tool bits for example screwdriver blades 10, and finger notches 53 at two opposite sides of each longitudinal compartment 52 for the insertion of the fingers to pick up screwdriver blades 10 from the longitudinal compartments 52.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A tool handle for hand tools, comprising:

a handle body having a polygonal coupling hole at a front end thereof adapted for holding a tool bit, two raised grip portions and two longitudinal open chambers alternatively arranged around the periphery, each of said longitudinal open chambers comprising an upper receiving section, a bottom coupling section, and two grooves in said bottom coupling sections at two opposite ends;

two tool boxes respectively mounted within the longitudinal open chambers of said handle body, said tool boxes each comprising a box body adapted for loading in the upper receiving section of one longitudinal open chamber of said handle body, two outward coupling flanges bilaterally raised from said box body and adapted for coupling to the bottom coupling section of one longitudinal open chamber of said handle body, two tongues raised from a bottom side of said box body at two opposite ends and adapted for engaging the grooves of one longitudinal open chamber of said handle body, and a plurality of tool holes defined within said box body and adapted for holding different tool bits and accessories.

* * * * *